United States Patent [19]

Li et al.

[11] Patent Number: 4,544,594

[45] Date of Patent: Oct. 1, 1985

[54] FOAMED POLYAMIDE FIBERS

[75] Inventors: Hsin L. Li, Parsippany; Hendrikus J. Oswald, Morristown, both of N.J.

[73] Assignee: Allied Corporation, Morris Township, Morris County, N.J.

[21] Appl. No.: 679,521

[22] Filed: Dec. 7, 1984

Related U.S. Application Data

[62] Division of Ser. No. 490,070, Apr. 29, 1983.

[51] Int. Cl.[4] ..... D02G 3/00

[52] U.S. Cl. ..... 428/92; 264/54; 428/97; 428/398; 428/401

[58] Field of Search ..... 264/54; 428/92, 97, 428/398, 401

[56] References Cited

U.S. PATENT DOCUMENTS 4,407,889 10/1983 Gintis et al. ..... 428/97

4,425,393 1/1984 Benedyk et al. ..... 428/398

*Primary Examiner*—Marion E. McCamish

*Attorney, Agent, or Firm*—Gus T. Hampilos; Gerhard H. Fuchs

[57] ABSTRACT

A molten polymer containing a blowing agent and, usually, a nucleating agent, is spun into fibers with screen packs or equivalent structures upstream of the spinning apertures. The use of screen packs enables the production of fibers with finer bubbles, which are therefore susceptable to greater melt-drawdown and post-drawing and can have better tensile properties. Foamed polyamide fibers are produced with average bubble diameters one-twentieth or less, compared to the effective fiber diameter.

6 Claims, 4 Drawing Figures

FOAMED POLYAMIDE FIBERS

This application is a division of application Ser. No. 490,070, filed 4/29/83.

BACKGROUND OF THE INVENTION

The present invention relates to a process for forming fine-celled foamed fibers, and especially to such processes employing a combination of molten polymer containing therein, a dissolved decomposable compound or gaseous blowing agent, extrusion (spinning) conditions and elements of the extrusion (spinning) apparatus. The present invention also includes novel foamed polyamide fibers which may, but are not necessarily, produced by the present process.

Foamed thermoplastic (and especially polyamide) fibers have been produced, especially for the purpose of being broken (fibrillated) into three-dimensional structures of interconnected fiber elements. See U.K. Patent Specification Nos. 1,221,488 (1971), 1,296,710 (1972) 1,316,465 (1973) and 1,318,964 (1973), all of Monsanto Chemicals Limited. Water is said to be the preferred blowing agent in most of the cases, and nucleating agents such as talc or powdered silica are also used.

Foaming polyester and polyamide fibers for textile applications is disclosed in DOS No. 2,148,588 (Apr. 5, 1973) (see Example 7). See also Chem. Abstr. 90:24692m (1979) of Japanese Kokai No. 78,106,770.

Screens or porous discs are conventionally used in fiber spinning to help to distribute the polymer or to create sheer or pressure drop or to remove grit in various solid particles from the polymer melt. The latter effect is to prevent such solid particles from clogging the spinning orifices (capillaries). See, for example. U.S. Pat. Nos. 3,006,028 to Calhoun (1961), 3,028,627 to McCormick (1962), 3,295,161 to Mott (1967), and 3,847,524 to Mott (1974). Applicants are not aware of any specific teaching to use fine screen structures in spinning polymer containing a blowing agent.

Hollow fibers are also known to the art containing elongated voids (usually extending long distances or the entire length of each filament in the longitudinal direction). Such fibers contain large void volumes and find use in thermal insulation. The voids are generally produced by the use of modified spinning dies.

BRIEF DESCRIPTION OF THE INVENTION

The present invention includes a method of forming fine-celled foamed fibers which comprises the steps:

(a) Forming at elevated temperature and under superatmospheric pressure a melt of a polymer of fiber-forming molecular weight in which is admixed with a blowing agent (FIG. 1);

(b) Extruding said melt in a spinnerette (FIG. 1B) having at least one aperture, with said melt passing through a plurality of small channels upstream of said at least one spinnerette aperture (FIGS. 1A and 2);

(c) Quenching said melt downstream of said at least one spinnerette aperture under conditions at which a plurality of predominately closedcell bubbles form in said melt; and (d) Drawing said melt as it is quenched.

The present invention also includes a foamed polyamide fiber having an equivalent diameter of between about 0.01 and about 1.0 mm and a plurality of predominately closed-cell bubbles of diameter less than one-twentieth the diameter of the fiber, on a number average basis.

DETAILED DESCRIPTION OF THE INVENTION

Figure 1:
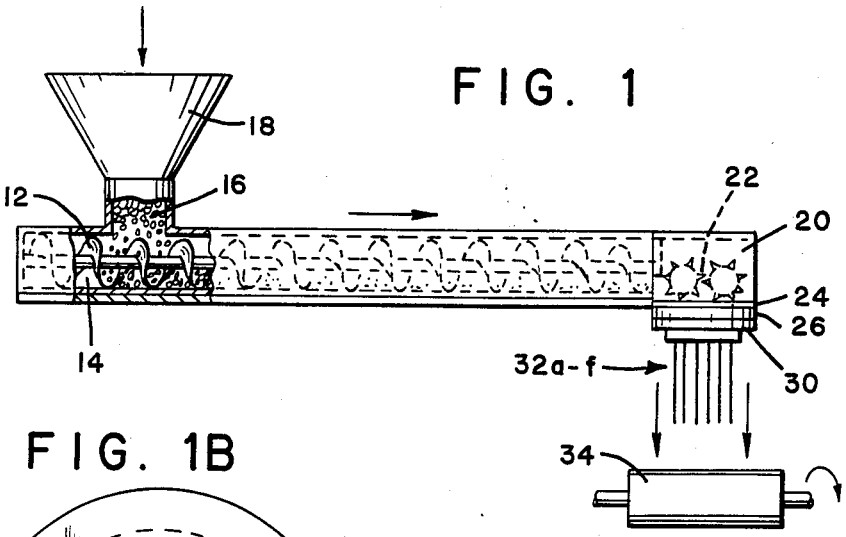

The process of the present invention involves the extrusion of a polymer melt containing, dissolved or dispersed therein, a blowing agent which is a decomposable compound or dissolved gas. The polymer may be any of a variety of conventional thermoplastics used in fiber production: polyesters such as poly(ethylene terephthalate); polyamides such as nylon 6, nylon 66, nylon 6/12; polyeolefins; and poly(vinyl chloride).

The preferred thermoplastics for use in the present invention are polyamides, and especially nylon 6 and nylon 66. The polymers should be of fiber-forming molecular weight, a term well understood in the art, which, in the case of nylon 6 and nylon 66, generally means a number average molecular weight at least about 10,000.

The blowing agent may be a compound dissolved or dispersed in the molten polymer which, before reaching the spinning temperature, decomposes to form gases such as carbon dioxide, nitrogen, carbon monoxide or mixtures thereof. The preferred material azodicarbonamide decomposes to form nitrogen, carbon dioxide and ammonium in a 6:3:1 molar ratio. Materials which totally decompose to produce gaseous materials such as nitrogen, ammonia, carbon dioxide, carbon monoxide and water vapor, or combinations of these are preferred. Oxalic acid is such a material. Less preferred, but still suitable, are materials such as alkali metal carbonates and bicarbonates which decompose to form carbon dioxide and at least one non-volatile by-product, e.g., other sodium salts such as hydroxides or carbonates.

The blowing agent may also be a normally gaseous or volatile compound such as a fluorocarbon or water mixed or injected into the polymer melt before or during extrusion. Examples of such blowing agents include carbon dioxide, nitrogen, noble gases, dichlorodifluoromethane, trichlorotrifluoroethane, water and volatile hydrocarbons.

The decomposition temperature of the decomposable compound and boiling point of the normally-gaseous or volatile compound should be selected to assure that bubbles form in the polymer melt at the spinning temperature as the pressure drops. Such bubbles should not collapse or redissolve in the extended fiber prior to the polymer solidifying.

The polymer melt will normally also include a nucleating agent such as talc, silica (powdered or fumed), titanium dioxide or magnesium or calcium carbonate. Such nucleating agent may be premixed with the decomposable compound as is the case of azo compounds premixed with silica and sold by BFC Chemicals, Inc. of Wilmington, Del. as FICEL ® EPA, EPB, and EPC and EPD self-nucleating blowing agents. Alternatively, the nucleating agents may be separately mixed with the solid or molten polymer. While the exact concentration of the blowing agent or decomposable compound in the polymer is not critical, it has been found that, for any particular polymer and blowing agent or decomposable compound, the preferred range of proportions will be relatively narrow for a particular set of spinning conditions. Thus, for example, in the examples that follow, azodicarbonamide/silica concentrations between about 0.1 and about 0.5% are highly effective, with greater amounts either being of no benefit or detrimental.

Spinning apparatus used in the practice of the process of the present invention may be formed by relatively minor modification of conventional apparatus for spinning ordinary fibers of the same polymer. Thus, for example, in spinning nylon 6 fibers, ordinary powder or pellet feed systems, extruders and spinnerettes may be used. Such spinnerette may have one or a multiple of apertures. Each aperture may have various l/d ratios and various cross-sectional shapes (e.g., circular cross-sections, trilobally-shaped cross-sections, hollow-shaped cross-sections or y-shaped crosssections). Regardless of the shape used, the equivalent diameter (the diameter in the case of a circle, an equivalent dimension giving the same cross-sectional area for other shapes may vary widely from about 0.1 mm to about 1 mm, with an equivalent diameter between about 0.01 and about 0.1 mm being preferred and between about 0.01 and about 0.03 being more preferred. Preferred l/d ratios (orifice length to diameter) for the present invention are between about 30:1 and about 1:1, the lower range of which is substantially less than that used for spinning polyamide fibers normally.

The apparatus used in the present process should have upstream of, and preferably immediately upstream of, the spinnerette a screen pack or equivalent structure which forms a plurality of small channels having major cross-sectional dimensions less than 0.1 mm (the pore size of a porous plate structure or the mesh size of a screen). In the case of screens, screen packs containing multiple layers are preferably used, with the above dimension applying to the finest screen in the pack. As is conventional, the screen pack normally contains the finest screens near the middle of the stack, with coarser screens above and below the finest screens in order to provide support below the finest screens and to filter out larger particles and the like upstream of the finest screen. In some embodiments, multiple screen packs are used, with each containing a finest screen or screens near the middle of the pack. Such multiple screen packs may be immediately adjacent to each other or may be separated by a distributor plate or other structure designed to affect molten polymer flow, which affects the pressure drop and thereby bubble formation.

It is shown by the following Examples that best results are obtained when using multiple screens arranged in particular fashions. In general, it is preferred to align screens in stacked parallel fashions, each screen normal to the direction of polymer flow in the spinning pot. It is especially preferred that the wires running in one direction in each screen be substantially parallel, rather than skewed, relative to wires running in one direction of each other screen in the stack. Within the screen pack, it is preferred to place a very coarse supporting screen or screens nearest the spinning apertures and to arrange the remaining screens in one of two arrangements: in order of increasingly finer mesh in the direction of polymer flow (the normal order), and in order of increasingly finer mesh in the direction opposite that of polymer flow (the reverse order). Example 8 shows that screens arranged in the reverse order produced fibers of superior mechanical properties compared to screens arranged in the normal order in Examples 7 and 9.

At least some of the screens should be placed immediately above (less than 2.2 mm upstream of) the spinning apertures. It is contemplated that other structures such as distributor plates and other screens, sintered plates, sand-packs and the like may also be present further upstream. It appears, however, that the fine and uniform foam structures of the presently produced fibers are attributable to the screen structures (and the equivalent structures) placed immediately above the spinning apertures and could not be caused by similar structures present only at a point further upstream such as above a distributor plate.

It has been found that, for any particular practice of the present process, some minimum combination of screen number and sufficiently small finest screen structure is required to achieve the fine bubble structure described below in the product fiber. Such a fine bubble structure is necessary in small diameter fibers (e.g. 0.01–0.1 mm or 0.01–0.03 mm effective diameter) since large bubbles would result in low tensile strength or breakage of the fiber wall. It is difficult to quantify the minimum number of screens or the fineness required of the finest screen in the pack in general terms in the absence of other parameters such as polymer, decomposable compound, proportion of decomposable compound, spinning temperature, spinning pressure and the like. Nevertheless, as described in some of the examples below, for a particular embodiment of the invention wherein sufficient numbers of screens are used and the finest screen is sufficiently small, one can, by routine experimentation, remove screen or substitute coarser screens incrementally and observe a deterioration of foam structure in the product fibers with all other parameters held constant. It is believed that, in most cases, this deterioration will be relatively minor up to a certain stage of screen pack modification; but that, once the screen pack has been modified to a critical point, further modification will cause more rapid and severe deterioration. It is generally preferred that the smallest screen be between about 50 mesh/cm and about 300 mesh/cm.

For a particular polymer/blowing agent combination, spinning pressure will generally have a particular minimum value below which good quality fibers do not form. While spinning pressure (measured just above the screen pack immediately above the spinning apertures) can be controlled by positive displacement melt pumps, the aperture size and arrangement in the spinnerette and the screen pack mesh sizes and arrangement will have a significant effect on test pressure because they together cause the back-pressure necessary to maintain the spinning pressure.

The extrusion method generally used to form the molten polymer solution may be any technique used in the extrusion of thermoplastics, with devices for blending in the blowing agent or decomposable compound, nucleating agent (such as talc or silica) and other additives (such as surfactants) being those well known for the extrusion of fibers. For example, the decomposable compound may be master-batched with some of the polymeric material in one extruder, which is fed at right angles into a main extruder containing polymeric material fed to the main extruder as a powder or as pellets. The extruder generally feeds a melt pump or other similar apparatus to create the high pressure needed for fiber production. As is conventional, the polymer is heated in stages through the main extruder, and may be further heated immediately before or after the melt pump.

Once the fiber is extruded through the screen packs (or other similar structures) and the spinnerette apertures, the resultant molten fibers are quenched downstream of the spinnerette under conditions at which a plurality of predominately closed cell bubbles will form and are stabilized in the melt. Such bubbles will contain (for example) carbon dioxide, may contain other by-products of compound decomposition (e.g., nitrogen and ammonia) and may also contain other volatile materials which are added as such to the polymer melt (e.g., fluorocarbons). The quench temperature should be one at which the molten fibers solidify. Furthermore, the quench temperature which is generally within several degrees of room temperature (e.g., 20° C.) should be one at which bubble coalescense, bubble diffusion to the polymer surface and redissolution are minimized. As the melt is quenched, it is also normally drawn so as to control the diameter (or the denier) of the fiber to a desired degree. Because of the high viscosities of most fiber-forming polymeric materials, it is conventional to extrude through spinnerette apertures of major cross-sectional dimension much larger than the desired alternate fiber mentioned. Furthermore, since, once the molten fiber has solidified, it is relatively difficult to draw to a large extent (e.g., more than about 5:1), the most appropriate place to draw is during the molten state and the quenching operation. In the present process, melt drawing at that stage may be between about 2:1 and about 1000:1; and, at least in the case of polyamides, is preferably between about 4:1 and about 200:1. It has been found that the plurality of predominately closed-cell bubbles formed during the quenching operation are neither destroyed nor rendered open-cell by the drawing step. Instead there may be some tendency for bubbles to elongate somewhat in the longitudinal direction. The product fibers of the above process arte generally of finer bubble structure and hence of more substantial physical properties than fibers produced in accordance with the above-described British patents or German patent. Thus, for example, in product fibers having a denier (grams per 9000 meters) of between about 2 and 100, a representative crosssection of each filament may have between 1 and about 300 bubbles, respectively, visible under an optical microscope, amounting to several percent (e.g. 10–30%) of the visible cross-sectional area.

A preferred form of fibers produced by the present process are the foamed polyamide fibers described above in the brief description of the invention. Such fibers have an effective diameter between about 0.01 mm and about 1.0 mm and preferably between about 0.01 mm and about 0.1 mm. Such dimension corresponds generally to a denier between about 0.8 and 8000, preferably between about 0.8 and about 800. Excellent carpets can be formed from such fibers, especially with deniers of about 15–30. Such carpets have added coverage without loss of other properties (e.g. wearability and resilience). More preferably, the effective diameter will be about 0.01 to about 0.03 mm. Because of the bubbles, the density of such fibers will normally be between about 40 and about 85% of the density of unfoamed polyamide fibers of similar cross-sectional dimension. Accordingly, since denier is based upon weight, lower denier fibers of the same cross-sectional area are created. The bubbles in such fibers have a diameter (in the cross-sectional direction) less than about 25 micrometers and preferably less than about 1 micrometer. Such bubbles are predominately (more than half) closed-cell in the sense that photomicrographs will show more than half of the bubbles without a connection to the exterior fiber. It is preferred, however, that such cells be entirely closed along their length such that filaments with a smooth surface are formed.

The foamed fibers produced by the present process, and especially the foamed polyamide fibers of the present invention, are useful in a variety of applications based upon their reduced density and increased crimping tendency. Such applications include carpets, upholstery, apparel, camping equipment (including tents and sleeping bags), luggage, ropes or nets and filters of various kinds. The foamed fibers may be formed for such application in woven and nonwoven fabrics, tufted or otherwise fabricated in ways conventional for non-foamed fibers. The retention of physical properties (especially tenacity and tensile modulus) improves the performance of the present fibers in such applications.

EXAMPLES

Figure 1B:
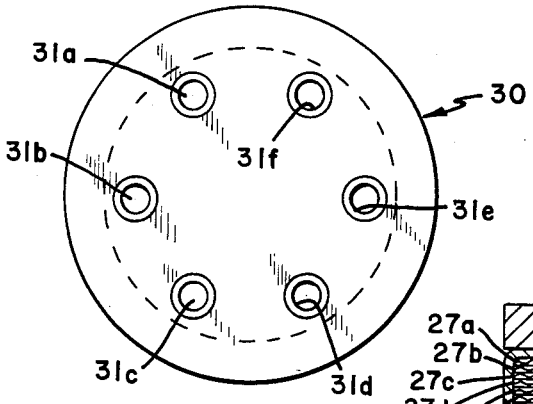
Figure 1A:
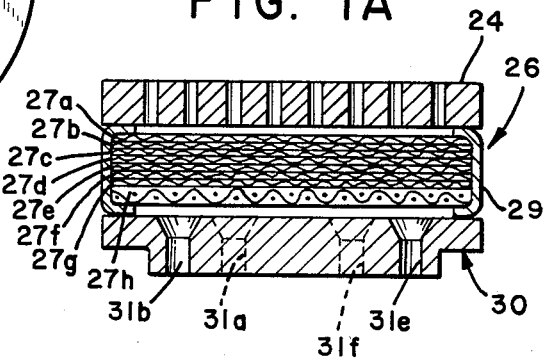
Figure 2:
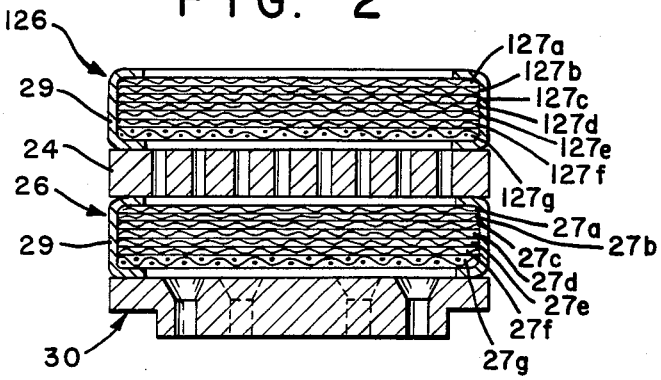

The spinning examples of the following Examples were performed in an apparatus illustrated schematically in FIG. 1 (with an enlarged view of elements 24, 26 and 30 in FIG. 1A) or in an apparatus, part of which is illustrated schematically in FIG. 2.

Referring to FIGS. 1 and 1A, a heated extruder 12 containing an extrusion screw 14 propels a mixture 16 of polymer, decomposable compound and nucleating agent fed in hopper 18 at the upstream end of the extruder 12 toward a spinning apparatus 20. Within the spinning apparatus 20, positive-displacement melt pumps 22 propel the now molten polymer mixture through a distributor plate 24 and screen-pack 26 toward a spinnerette head containing apertures 31*a*, 31*b*, 31*c*, 31*d*, 31*e*, and 31*f* (see FIG. 1B). The screen pack 26, immediately above the spinnerette head 30 contains a series of screens of different mesh size: uppermost screen 27*a*, second screen 27*b*, third screen 27*c*, fourth screen 27*d*, fifth screen 27*e*, sixth screen 27*f*, seventh screen 27*g* and support screen 27*h*. In each Example referring to FIG. 1, the screens are listed in this order from uppermost to support screen. A seal 29 (lead solder) is applied to the outside of all of the screens, holding them in fixed parallel array and preventing the flow of molten polymer around the screens.

Multiple filaments 32*a*–32*f* are melt drawn from the apertures 31*a*–31*f* by a take-up roller 34, cooling in the quench zone between the head 30 and the take-up roller 34 to solidify the polymer while retaining the foamed structure.

FIG. 2 is identical to FIG. 1 except that two screen packs 126 and 26 are present, respectively, above and below the distributor plate 24. Thus, uppermost screen-pack 126 above distributor plate 24 contains uppermost screen 127*a*, second screen 127*b*, third screen 127*c*, fourth screen 127*d*, fifth screen 127*e*, sixth screen 127*f* and support screen 127*g*. Lower screen pack 26 below the distributor plate 24 contains uppermost screen 27*a*, second screen 27*b*, third screen 27*c*, fourth screen 27*d*, fifth screen 27*e*, sixth screen 27*f* and support screen 27*g*.

EXAMPLE 1

Nylon 6 (polycaproamide) in powder form was homogeneously mixed with 0.5% by weight of sodium bicarbonate in powder form. The powder blend was extruded through an extruder of one inch (25.4 mm) diameter screw with a length to diameter ratio 25. The spinnerette used has a geometry of 0.040" (1.02 mm) diameter×0.080" (2.03 mm) capillary length×6 holes. Immediate on top of the spinnerette, a screen pack was placed. The screen pack consists of eight layers of screens, i.e., 90 mesh (uppermost screen 27*a* in FIG. 1) /200 mesh / 200 mesh/400 mesh/ 400 mesh / 200 mesh /200 mesh / 90 mesh / with two coarser screens of 20 mesh / 20 mesh (support screen 27*h* of FIG. 1) as additional support. As used herein, the term "mesh" refers to number of wires per inch. Conversion to number per cm is tabulated at the end of these Examples. The extrusion flow rate was 11 g/min and the extrusion pressure was 700 psi (4.8 MPa) measured immediately above the screen structures (above screen 27*a* in FIG. 1). The yarn was quenched immediately with cool air at a temperature of 64° F. (18° C.). The quenched yarn was taken up on a winder at a speed of 1,320 feet per minute (400 m/min.). The yarn, in its undrawn state, had a total denier of 220 of 6 filaments; each filament had an undrawn denier of 36.7.

The yarn was drawn later on a yarn drawing machine. The feed roll speed was 600 fpm (182 m/min.) at a temperature of 100° C., a heater block of temperature of 170° C. and a draw roll speed of 185° C. at a speed of 1,200 fpm (364 m/min.). The yarn was drawn 2× with a final drawn denier of 110 denier / 6 filaments.

The drawn foamed yarn of 110 denier/ 6 filaments had a density of about 0.95 g/cm$^3$. The foam cells are randomly distributed across the yarn bundle when viewed through a microscope. The population of cell per filament varies from one up to approximately 30. The foamed yarn also had good tensile strength of about 2 g/denier.

COMPARATIVE EXAMPLE 2

Example 1 was repeated with the exception that the screen pack was replaced by a screen structures of 4 layers consisting of 90 mesh (uppermost screen 27*a* in FIG. 1) /200 mesh / 200 mesh /400 mesh, with two 20 mesh screens as support screen 28. The pressure measured above screen 27*a* was 300 psi (2 MPa). The extruded foam yarn quality was very poor with a density of greater than 1.0 gm/ cc. while the cell disappeared from some of the filaments.

EXAMPLE 3

Nylon 6 in powder form was homogeneously blended with 0.5% sodium bicarbonate in powder form. The blend was extruded through a 0.75" (19 mm) diameter extruder with a single hole die of 0.170" (43 mm) diameter. The screen arrangement was as shown in FIG. 1 with screens of 90 mesh/200 mesh/200 mesh/400 mesh/20 mesh. The extrusion temperature was 520° F. (271° C.). The extruded foam rod of 0.2" (5 mm) diameter has a density of 0.49 g/cm$^3$. Photomicrographs reveal the foam cells are uniform having spherical shape. The foam rod, during extrusion, near the immediate exit end of the die hole could be drawn at a winder speed of 150 fpm (45 m/min.) The drawn foam denier of 2,027 has a density of approximately 0.49 g/cm$^3$.

COMPARATIVE EXAMPLE 4

Example 3 was repeated with the exception that the screen pack was completely removed. Extrusion was very unstable. For instance, the extrudate sometimes traveled at a speed of 50 fpm (15 m/min.) and sometimes at a speed of only 10 fpm (3 m/min.). Occasionally, very large cells were observed in addition to small cells.

EXAMPLE 5

Nylon 6, in powder form, was homogeneously mixed with FICEL® EPA blowing agent in powder form (0.3% by weight). The chemical blowing agent was azodicarbonamide (0.18%) which has a decomposition temperature of 190° C. to 220° C. yielding gas volume of 210 mL / gram and 0.12% silica powder. The gas produced consists of 60% nitrogen and carbon monoxide, 30% carbon dioxide and 10% ammonia. The blend was extruded through a 1" (25.4 mm) extruder at a spinnerette temperature of 470° F. (243° C.). The spinnerette had 6 holes with a trilobal cross-sectional area per hole of $3.2\times10^{-3}$ cm$^2$. In other words, it had the equivalent cross-sectional area of a 0.025" (0.635 mm) diameter round die. The molten blend, before emerging from the spinnerette plate flowed through a series of screen packs, distributor plate to uniformly distribute the flow and another series of screen pack and then the spinnerette as illustrated in FIG. 2. A series of screen pack consists of 6 mesh to avoid buckle under pressure, then 90/200/200/400/ 400/200/200/90, 90/200/200/400/400/200/200/90, then a distributor plate of 0.75" (19 mm) thick (with hole diameter of 0.125" (3.2 mm) and 0.25" (6.4 mm) apart), and then 200/200/20/20/6 mesh) as a support of fine screens. The pressure above the last screen pack varied over between 540 and 650 psi (3.7 MPa and 4.5 MPa). The flow rate was 32 grams/minute through the spinnerette and taken up on a winder at a speed of 4,000 fpm (1212 m/min.). The undrawn yarn had a denier of 240 denier/6 filaments. The yarn was drawn to a total draw ratio of 2× in two stages with the first roll speed of 1,000 fpm (303 m/min.) at a room temperature, the second roll speed of 1,100 fpm (333 m/min.) at 110° C. and the final draw roll speed of 2,000 fpm (606 m/min.) at 160° C. The drawn foam yarn had a trilobal denier of 120/6 with a density of 0.88 g/cm$^3$. The tensile properties were maximum tensile strength of 2.9 g/denier, tensile modulus of 37 g/denier and elongation at break of 29%. Each pound of foam yarn consists of, at least, one billion cells. Each single filament cross section has approx. 5 foam cells.

EXAMPLE 6

Example 5 was repeated except that all of the screens were removed. The pressure dropped to 200 psi (1.4 MPa). The extruded foamed yarn was weak and the density was approximately 0.88 g/cm$^3$. The yarn could not be drawn to 2× and broken filaments were observed during drawing even at a lower draw ratio. The tensile strength of the foamed yarn was less than 2 g/denier.

The above example and example 5 clearly show the importance of the screens upon foamed yarn properties, or the maximum draw ratios. Drawing is a critical test of the uniformity of bubble formation. Any exceptional larger bubble will cause yarn breakage during drawing, but these larger bubbles cannot conveniently be observed on a microscope because the total cells per pound of foamed yarn exceeds one billion.

EXAMPLE 7

Nylon 6 pellets were homogenously mixed with 0.3% by weight of the FICEL® EPA self-nucleated blowing agent of Example 5 in powder form. Using the general configuration of FIG. 1, the blend was extended using a one inch (25.4 mm) diameter screw to a spinnerette at a temperature of 530° F. (276° C.) having the spinnerette plate with 12 apertures, each 0.010 inch (0.254 mm) diameter and 0.035 inch (0.889 mm) length. The screen pack below the distributor plate and immediately after the spinnerette plate had four layers of 90 mesh on top (27*a*), four layers of 200 mesh next, four layers of 400 mesh next and one layer of 6 mesh as support screen 28. The flow rate was 32 g/min. and the extrusion pressure 2500 psi (17.2 MPa) measured near the die exit. The extruded yarn was taken up by a winder rotating at a speed of 2000 feet per min (606 m/min.) and had a denier of 483 for 12 undrawn filaments. After drawing 3.38×as in Example 5, a 143 denier/12 filament yarn was produced with 2.78 g/denier tensile strength, 39.93 g/denier tensile modulus and 13.37% elongation at break. The drawn foamed fiber had a density of 0.77 g/cm$^3$. Each yarn cross-section showed an average of seven cells by optical microscopy.

EXAMPLE 8

Example 7 was repeated with the screen structure reversed to be, from to upstream end, four layers of 400 mesh, four layers of 200 mesh, four layers of 90 mesh and one layer of 6 mesh as support. The spun yarn (480 denier/12 filament) could be drawn 3.8×to 125 denier/12 filaments. The drawn yarn had properties of 3.06 g/denier tenacity, 44.5 g/denier tensile modulus and 10.8% elongation at break. This represents a finer denier and better mechanical properties compared to the yarn produced in Example 7.

EXAMPLE 9

After Examples 7 and 8 were conducted (in that order), Example 7 was repeated by returning the screen pack to the original configuration. The spun yarn could be drawn only 3.1×to 147 denier/12 filament, with properties of 2.59 g/denier tenacity, 42.3 g/denier tensile modulus and 19.9% elongation.

EXAMPLE 10

Polyester pellets (polyethylene terephthalate) of weight average molecular weight 83,900 were homogeneously mixed with a chemical blowing agent of 0.25% by weight in powder form. The chemical blowing agent is known commercially as Celogen ® HT500 manufactured by Uniroyal Chemical Co. Celogen ® HT500 has a decomposition temperature of 250° C. Upon decomposition, it evolves approximately 34% $CO_2$, 27% propylene gas, 24% isopropanol, 7% $N_2$, 5% methane, etc. No nucleating agents were added to the above compositions.

The blend as extruded through a 1" (25.4 mm) diameter extruder at a spinnerette temperature of 520° F. (271° C.). The spinnerette had 6 holes and each hole has a diameter of 0.040" (1.0 mm).

The screen structure consists of eight layers of 200 mesh, then four layers of 90 mesh and, last, one layer of 6 mesh as a support. The screen structure was completely sealed with lead around its edge. The screen structure was placed immediately on the top of the spinnerette plate. The flow rate was 24 grams per minute and the extruded yarn was taken up with a winder speed of 2,080 fpm (630 m/min.) and was 58 denier/6 filaments. The foamed yarn has a void volumetric content of approximately 25%. Each filament had approximately 5 cells on an average by optical microscopy.

EXAMPLE 11

Example 10 was repeated except that the flow rate was increased from 24 grams per minute to 36 grams per minute. No foam cells were observed.

EXAMPLE 12

High density polyethylene pellets, known commercially as PAXON ® polyethylene manufactured by Allied Corp., were homogeneously mixed with a chemical blowing agent of 0.6% by weight in powder form. The chemical blowing agent used is known commercially as FICEL ® AF-100 produced by BFC Chemicals, Inc., FICEL ® AF-100 consists of mainly inorganic carbonate plus nucleating agent of finely dispersed talc powders. Upon decomposition, it generates $CO_2$ gas and zinc oxide about 45% as a solid residue.

The blend was extruded through a 1" (25.4 mm) extruder at a spinnerette temperature 550° F. The spinnerette and screen structures used were as in Example 5.

The flow rate was 10 grams per minute and extrusion pressure was 2,000 psi (13.8 MPa). Foamed polyethylene yarn of 13020 den/6 filaments was collected immediately after extrusion. The foamed yarn has a density of about 0.9 g/cm$^3$ and each filament has about 3 cells on average.

EXAMPLE 13

Nylon 6 pellets were tumbled with 0.3% by weight of the FICEL ® EPA self-nucleating blowing agent of Example 5. A hollow-fiber spinnerette having 10 holes, each 0.060 inch (1.52 mm) outside diameter and 0.050 inch (1.27 mm) inside diameter, was used in the general arrangement of FIG. 1; and the spinnerette temperature was maintained at 520° F. (271° C.). The screen structure was 90 mesh (top screen 27*a*), 200 mesh, 200 mesh, 400 mesh, 400 mesh, 200 mesh, 200 mesh, 90 mesh (support screen 28). The extrusion rate was 11.7 g/min. and the pressure/measured above screen 27*a* was 800 psi (5.5 MPa). Take up was at a winder speed of 2,400 fpm (727 m/min.). Photomicrographic revealed one to four randomly-distributed cells in addition to the hollow center. The yarn was 65 denier/10 filaments with a density of approximately 0.95 g/cm$^3$.

EXAMPLE 14

Using the procedure of Examples 5 and 12 PAXON ® polyethylene was blended with 0.3% inorganic carbonate and spun through a spinnerette of 6 trilobal apertures. The screen pack, oriented and sealed at the edge, had four layers of 400 mesh (top screen 27*a*) and eight layers of 200 mesh, four layers of 90 mesh and one layer of 6 mesh as support screen 28 (the reverse order of Example 8). The flow rate was 10 g/min., the spinnerette temperature was 550° F. (280° C.) and the extrusion pressure measured above screen 27*a* was 1970 psi (13.6 MPa). Each filament was 2170 denier. The fiber density was 0.9 g/cm$^3$.

EXAMPLE 15

Polypropylene pellets were mixed with 0.3% of the FICEL ® EPA self-nucleating blowing agent of Example 5. The spinnerette had 6 holes, each of 0.04 inch (1.0 mm) diameter. Using the arrangement of FIG. 1, the screen pack used was eight layers of 200 mesh, four layers of 90 mesh and one support layer of 6 mesh, lead sealed around the edges. The spinnerette temperature was 440° F. (227° C.), the flow rate was 15 g/min and the extrusion pressure was 20 psi (0.14 MPa). The extruded yarn had approximately 26% void space. Each filament was approximately 447 denier and averaged approximately 30 cells by optical microscope.

EXAMPLE 16

Nylon 6 in powder form was homogeneously mixed with 0.5% by weight of sodium bicarbonate in powder form and also 0.5% by weight of fumed silica. The powder blend was extruded through an extruder of one inch (2.54 mm) diameter with a length to diameter ratio of 25. The spinnerette used has a geometry of 0.040" (1.02 mm) diameter×0.080" (2.03 mm) capillary length×6 holes. The screen pack consists of 18 layers of screens, i.e., 90 mesh/200 mesh/200 mesh/400 mesh/400 mesh/200 mesh/200 mesh/90 mesh/90 mesh/200 mesh/200 mesh/400 mesh/400 mesh/200 mesh/200 mesh/90 mesh/20 mesh/20 mesh as support. All the wires of the screens are parallel to each other to insure proper and consistent pressure drops through any given areas of the screen pack. The extrusioin flow rate was 7 g/min and the pressure drop was 400 psi (2.7 MPa). The yarn was quenched immediately with cool air at a temperature of 18° C., the quenched yarn was taken up on a winder at a speed of 910 fpm (276 m/min) and the yarn has a total denier of 198 of 6 filaments; each filament had an undrawn denier of 33.

The yarn was drawn later on a yarn drawing machine. The feed roll speed was 330 fpm (100 m/min) and the draw roll speed was 500 fpm (152 m/min) with the heater block temperature of 180° C. The yarn was drawn 1.53× with a final denier of 129/6 filaments.

The yarn of total 30 meters long was then cut every 5 meters and analyzed with an image analyzer (Leitz Model TAS, Texture Analyzing System, by Leitz, Inc.). The image analyzer is basically an optical microscope which transform an optical image on a CRT tube and digitized and analyzed which yielded the following results of the foamed yarns:

| | Diameter Micrometers | Deniers | Percent Void | Number of Voids |
|---|---|---|---|---|
| Minimum | 20.5 | 2.28 | 10.6 | 3.0 |
| Maximum | 116.28 | 90.64 | 41.7 | 35 |
| Average | 53.7 | 20.2 | 22.8 | 18.8 |

EXAMPLE 17

The foamed yarn produced as shown in Example 5 was textured in a stuffer tube. The textured yarn was then wound into a small skein and boiled in water for about 5 minutes. The yarn unwound from the skein of about 12" (30 cm) long was stretched under a weight of 0.002 g/denier and its length is measured as $L_o$ and then a weight of 0.5 g/denier was applied to the yarn and a new length is measured as L. A well known method to characterize the quality of the textured yarn is Crimp Extension after Boiling Test Procedure, or CEAB. In this instance, the $CEAB=(L-L_o)/L_o$ in percent was equal to 32%, which is considered a good texture level. The textured foamed yarn is therefore suitable for carpet yarn applications.

EXAMPLE 18

Nylon control yarn was prepared as indicated in Example 5 but without blowing agent, and was textured as indicated in Example 17. However, it had a CEAB=26% which was inferior to the foamed yarn.

The following Table 1 shows the conversion of mesh ($inch^{-1}$), the units used in the previous examples, to mesh ($cm^{-1}$). The good results with 400 mesh ($inch^{-1}$) as smallest screen support the preferred range of 50 mesh/cm to 300 mesh/cm for the smallest screen.

TABLE 1

| Mesh ($inch^{-1}$) | Metric Mesh ($cm^{-1}$) |
|---|---|
| 6 | 2.4 |
| 90 | 35.4 |
| 200 | 78.8 |
| 400 | 157 |
| 625 | 246 |

2.54 cm = 1 inch

What is claimed is:

1. A foamed polyamide fiber having an effective diameter of between about 0.01 and about 1.0 mm and a plurality of predominantly closed-cell bubbles of diameter less than one-twentieth the effective diameter of the polyamide fiber.

2. The foamed polyamide fiber of claim 1 having an effective diameter between about 0.01 and about 0.1 mm.

3. The foamed polyamide fiber of claim 2 having an effective diameter between about 0.01 and about 0.03 mm.

4. A carpet comprising the fiber of claim 2.

5. The carpet of claim 4 wherein the fiber is between about 15 and 30 denier.

6. The carpet of claim 4 wherein the fiber has been crimped.

* * * * *